US008656558B2

(12) United States Patent
Van Gennep

(10) Patent No.: US 8,656,558 B2
(45) Date of Patent: Feb. 25, 2014

(54) LOCKING HINGE ASSEMBLY

(76) Inventor: Jan Van Gennep, Lakeport, CA (US)

( * ) Notice: Subject to any disclaimer, the term of this patent is extended or adjusted under 35 U.S.C. 154(b) by 237 days.

(21) Appl. No.: 12/985,573

(22) Filed: Jan. 6, 2011

(65) Prior Publication Data

US 2011/0094058 A1 Apr. 28, 2011

Related U.S. Application Data

(63) Continuation-in-part of application No. 12/708,397, filed on Feb. 18, 2010, now Pat. No. 8,359,709.

(60) Provisional application No. 61/153,585, filed on Feb. 18, 2009, provisional application No. 61/316,963, filed on Mar. 24, 2010.

(51) Int. Cl.
*E05D 11/10* (2006.01)

(52) U.S. Cl.
USPC ..... 16/328; 16/229; 16/262; 16/353; 16/386

(58) Field of Classification Search
USPC ..... 16/265, 260, 261, 262, 263, 270, 254, 16/255, 256, 257, 258, 259, 319, 321, 328, 16/329, 331, 352, 353, 324, 381, 386, 229, 16/327
See application file for complete search history.

(56) References Cited

U.S. PATENT DOCUMENTS

| | | | | | |
|---|---|---|---|---|---|
| 2,542,340 | A * | 2/1951 | Mauraton | ..... | 16/381 |
| 3,448,486 | A | 6/1969 | Wright | | |
| 3,629,900 | A * | 12/1971 | Beerli, Jr. | ..... | 16/349 |
| 3,744,085 | A * | 7/1973 | Griego | ..... | 16/325 |
| 4,528,718 | A | 7/1985 | Brockhaus | | |
| 4,675,940 | A * | 6/1987 | Brockhaus | ..... | 16/273 |
| 4,854,009 | A * | 8/1989 | Brockhaus | ..... | 16/263 |
| 4,864,688 | A * | 9/1989 | Gerber | ..... | 16/261 |
| 4,991,259 | A * | 2/1991 | Finkelstein et al. | ..... | 16/312 |
| 5,577,295 | A * | 11/1996 | Papke et al. | ..... | 16/254 |
| 5,706,556 | A * | 1/1998 | Kluting | ..... | 16/273 |
| 5,820,288 | A | 10/1998 | Cole | | |
| 6,922,872 | B2 * | 8/2005 | Gruber | ..... | 16/260 |
| 7,325,276 | B2 * | 2/2008 | Kim | ..... | 16/262 |
| 7,603,746 | B1 * | 10/2009 | von Resch et al. | ..... | 16/245 |
| 8,156,611 | B2 * | 4/2012 | Machin et al. | ..... | 16/261 |
| 2004/0025294 | A1 * | 2/2004 | Gruber | ..... | 16/254 |
| 2009/0056075 | A1 * | 3/2009 | Green et al. | ..... | 16/328 |

* cited by examiner

*Primary Examiner* — Jeffrey O Brien
(74) *Attorney, Agent, or Firm* — Craig M. Stainbrook; Stainbrook & Stainbrook, LLP

(57) ABSTRACT

A locking hinge with a sliding hinge pin that selectively places the hinge in either a locked or unlocked configuration. The hinge pin includes cylindrical and contoured upper and lower exterior parts that cooperate with contoured upper and lower portions of the interior wall of the lower and upper sleeve members of the hinge. When in the locked configuration the lower contoured part of the hinge pin engages the contoured portion of the lower sleeve member and the upper contoured part engages the contoured portion of the interior wall of the upper sleeve, and in the unlocked configuration the lower contoured part of the hinge pin does not engage the contoured portion of the interior wall of the lower sleeve and the upper contoured part of the hinge pin does not engage the contoured portion of the interior wall of the upper sleeve.

11 Claims, 18 Drawing Sheets

LOCKING HINGE ASSEMBLY

CROSS REFERENCES TO RELATED APPLICATIONS

The present application is a continuation-in-part of U.S. patent application Ser. No. 12/708,397, filed (Feb. 18, 2010), which claims the benefit of U.S. Provisional Patent Application Ser. No. 61/153,585 filed (Feb. 18, 2009); and further claims the benefit of U.S. Provisional Patent Application Ser. No. 61/316,963, filed (Mar. 24, 2010).

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

SEQUENCE LISTING

Not applicable.

INCORPORATION-BY-REFERENCE OF MATERIAL SUBMITTED ON A COMPACT DISC

Not applicable.

BACKGROUND OF THE INVENTION

1.Field of the Invention

The present invention relates generally to hinge assemblies, and more particularly to hinges for closures, such as doors, windows, hatches, lids, ports, and the like, and also for panels or surface members that pivot in relation to another panel or surface member, such as shelves, awnings, ramps, gates, and the like.

2. Discussion of Related Art including information disclosed under 37 CFR §§1.97, 1.98

Locking hinges and hinge assemblies are known. Exemplary publications teaching such technology include:

U.S. Pat. No. 5,820,288 to Cole, which teaches an adjustable tool with a locking hinge mechanism. The tool may be moved between a number of selectable positions through the use of a hinge pin, which is splined along its length and holds the portions of the tool together. The hinge pin is movable between an unlocked position and a locked position. In the unlocked position, the tool is adjustable, and in the locked position the tool is fixed in position and ready for use.

U.S. Pat. No. 4,528,718 to Brockhaus shows a door hinge including a first and a second hinge member each having eyes with a hinge pin inserted through the eyes of the hinge members to connect them operatively together. The hinge pin is mounted so as to be freely rotatable relative to a first eye but secured against axial movement relative thereto. The hinge pin and a second eye are formed with axially extending splines engaged between them, and adjacent the splines also axially disposed is the hinge pin, which is formed with a cylindrical section that engages within a complementary cylindrical recess in the second eye, the cylindrical section having a diameter which is slightly greater than the addendum circle diameter of the splines.

U.S. Pat. No. 3,448,486 to Wright, teaches a locking hinge with a sliding adjustable pintle for locking cabinets, doors, lids, and the like. The pintle is formed with splines and is adjustable to a locked and unlocked position. In the locked position the splines engage hinge knuckles such that the hinge is prevented from turning. In the open position, the splines are disengaged from the knuckles and the hinge is free to turn.

The foregoing prior art reflects the current state of the art of which the present inventor is aware. Reference to, and discussion of, this prior art is intended to aid in discharging Applicant's acknowledged duty of candor in disclosing information that may be relevant to the examination of claims to the present invention. However, it is respectfully submitted that none of the above-indicated publications disclose, teach, suggest, show, or otherwise render obvious, either singly or when considered in combination, the invention described and claimed herein.

BRIEF SUMMARY OF THE INVENTION

The present invention is a novel hinge assembly that includes a first hinge member having a leaf and a lower sleeve. The lower sleeve includes an upper cylindrical passage with a first diameter and a lower cylindrical passage axially disposed immediately under the upper cylindrical passage and having a second diameter smaller than that of the upper cylindrical passage. The lower cylindrical passage has an interior wall with either a geometrical shape or surface topography. A second hinge member includes a leaf portion and an upper sleeve, the upper sleeve including an upper female portion and a lower male element extending axially downwardly from the female portion and has an outer diameter sized to fit tightly into the opening of the upper cylindrical passage of the lower sleeve so as to provide a smooth pivotal connection between the first and second hinge members. The male element further includes a lower portion with an interior wall configured substantially identically to that of the interior wall of the lower cylindrical passage of the lower sleeve. A through hole passes through the upper sleeve elements. When the male element of the upper sleeve is inserted into the lower sleeve, the through hole is axially aligned with the upper cylindrical passage and the lower cylindrical passage of the lower sleeve. A hinge pin is inserted into the upper cylindrical passage of the second hinge member and the lower cylindrical passage of the first hinge member. The hinge pin includes an outer surface configured or contoured in such a way to cooperate with the configuration of the interior wall of the lower sleeve. The hinge pin has an elevated unlocked position and a depressed locked position, such that when in the unlocked position no portion of the hinge pin outer surface engages the interior walls to prevent pivotal rotation of the hinge members in relation to one another, and when pushed into the down and locked position, the outer surface of the hinge pin engages the interior walls to prevent the hinge members from rotating in relation to one another.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

BRIEF DESCRIPTION OF THE SEVERAL VIEWS OF THE DRAWINGS

The invention will be better understood and its objects and advantages will become apparent when consideration is given to the following detailed description thereof. Such description makes reference to the annexed drawings wherein.

and

Figure 24B:
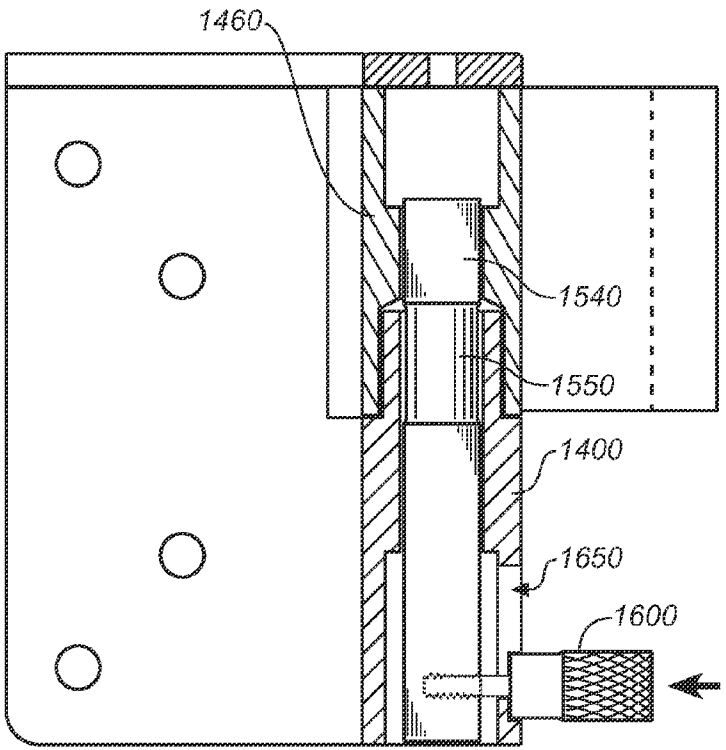
FIG. 24A is a front cross-sectional view showing the hinge in the unlocked position.

FIG. 24B is a front cross-sectional view showing the hinge in the locked position.

DETAILED DESCRIPTION OF THE INVENTION

Referring first to FIGS. 1 through 12, wherein like reference numerals refer to like components in the various views, there is illustrated therein a new and improved locking hinge assembly, generally denominated 100 herein. These views collectively show that the inventive hinge assembly includes a first hinge member 110 having a leaf portion 120 and a lower cylindrical sleeve portion (a gudgeon or eye) 130, which is roughly half the height of the leaf portion in dimension and extends along and is integral with the lower half of the interior edge 140 of the leaf portion. The lower sleeve 130 has an upper cylindrical passage 150 with a first diameter 160 and a lower cylindrical passage 170 axially disposed immediately under the upper cylindrical passage 150 and having a second diameter 180 smaller than that of the upper cylindrical passage. The lower cylindrical passage has an interior wall 190 that is splined (FIG. 8) or otherwise provided with a surface topography, e.g., gear teeth 192 (FIG. 9A) or with a cross-sectional shape 194 (FIG. 9B) so as to function as a locking element in cooperation with the hinge pin (described fully below).

The hinge assembly next includes a second hinge member 200 having a leaf portion 210 and an upper sleeve (eye or gudgeon) 220, the upper sleeve including an upper female portion 230 also comprising roughly half the height of the leaf portion and integral with the upper half of the inner edge 240 of the leaf portion. The upper sleeve further includes a lower male element 250 extending axially downwardly from the female portion and having an outer diameter 260 sized for a tight fit insertion into the opening of the upper cylindrical passage 150 of the lower sleeve 130 in a manner well known in the art so as to provide a smooth pivotal connection between the two hinge members. A lower portion 270 of the male element interior wall 280 is splined 290 or otherwise configured or shaped identically to that of the interior wall 190 of the lower cylindrical passage 170 of the lower sleeve 130.

The upper sleeve includes a recess 300 (or countersink) at its upper end 310 and having a first diameter 320 and a cylindrical through hole 330 having a second diameter 340. When the male element of the upper sleeve is inserted into the lower sleeve 130, the through hole 330 is axially aligned with the upper cylindrical passage 150 and the lower cylindrical passage 170 of the lower sleeve 130 so as to accommodate insertion of a hinge pin 350. The hinge pin includes an upper end 360 capped by an upper nut 370 threadably installed on the hinge pin. A helical compression spring 380 is disposed between the underside of the upper nut and the base 390 of the recess 300 in the upper sleeve. A lower nut 400 is threadably installed on the lower end 410 of the hinge pin. The helical compression spring is optional and is needed only when a single leaf hinge is employed, such as in a gate installation. While the spring may be employed to assist in keeping the hinge pin in an elevated (unlocked) position, the detent mechanism described below is sufficient for most applications.

Next, the outer surface 420 of a lower portion 430 of the hinge pin includes splines, gear teeth, or a shape or geometric cross-sectional configuration 440 that cooperates with the splined interior wall 190 of the lower sleeve 130 to prevent rotation of the hinge pin. It will be seen that when the hinge is pushed up into the unlocked position, no portion of the hinge pin splines engages the splines (or other topography or shape) to prevent pivotal rotation of the hinge.

The hinge pin further includes at least one, and preferably two, detent mechanisms, comprising first and second ball and spring combinations 450, 460, disposed in a through hole 470 drilled through the pin. A single spring may be employed with balls disposed at each end, and the balls are thus biased against the opposing sides of the interior portion of the female portion of the upper sleeve as the hinge pin travels through the upper sleeve. It will be seen that when the hinge pin is pushed down into the unlocked position (FIG. 6A) ball and spring combinations disposed in the through hole of the hinge pin cooperates with female portion of the upper sleeve prevent excursion of the hinge upwardly. When the hinge pin is pushed upwardly and out of the locked configuration (FIG. 6B), the helical compression spring 380 (if provided) and the ball and spring combinations 450, 460 work to prevent unwanted drop of the hinge pin back into the locked position. When in the locked position, the splines on the hinge pin engage both the interior wall 190 of the lower cylindrical passage 170 of the lower sleeve 130 and the splines of the male element interior wall 290 such that the hinge members are prevented from pivoting relative to one another.

In the illustrated exemplary embodiment, the hinge members are shown as conventional butt/mortise door hinges, each having a plurality of holes 480, 490, for securing the hinge member to a door and/or door frame, though countless other hinge styles and configurations may incorporate the inventive system disclosed herein.

Figure 2:
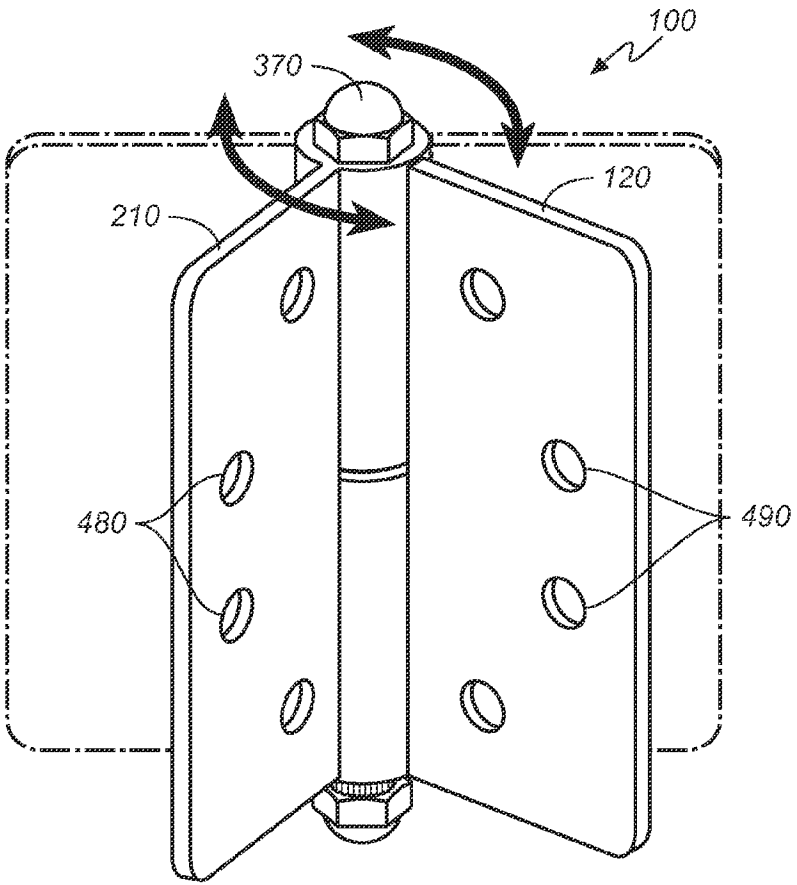
FIG. 2 is an upper front perspective view showing the possible hinge leaves rotation about the hinge pin when in an unlocked position so as to assume a partly closed position.
Figure 1:
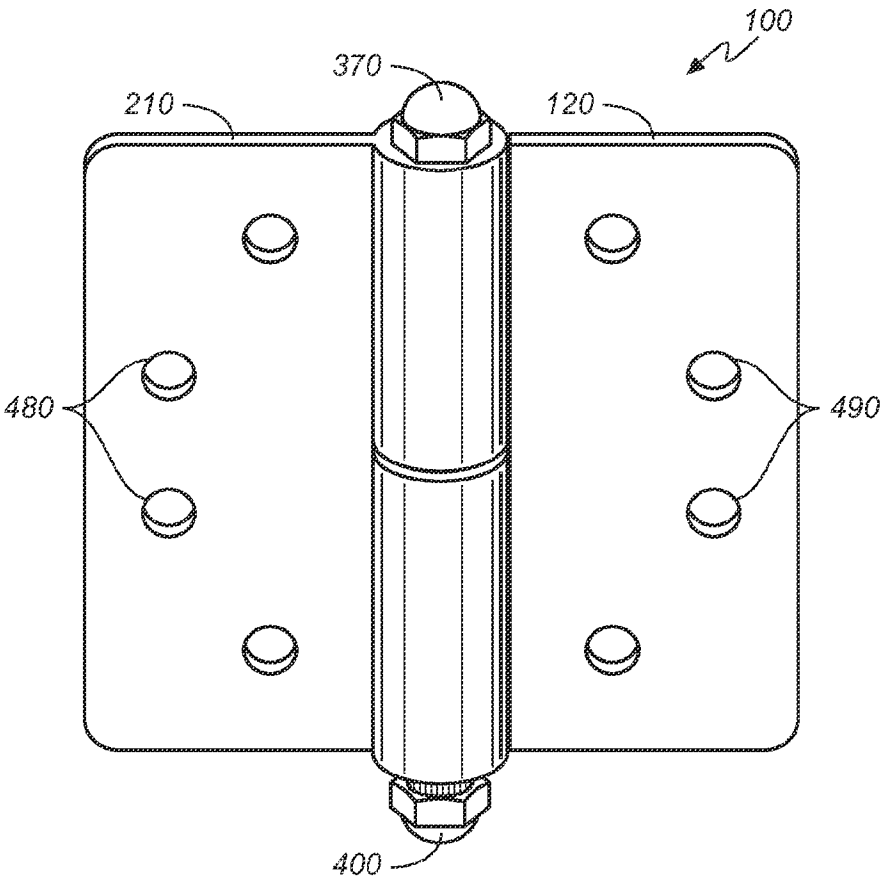
FIG. 1 is an upper front perspective view showing the inventive hinge assembly in a fully open and unlocked position.
Figure 1A:
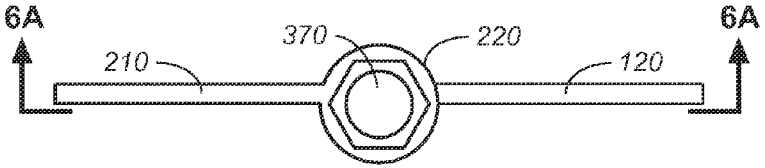
FIG. 1A is a top plan view thereof.
Figure 2A:
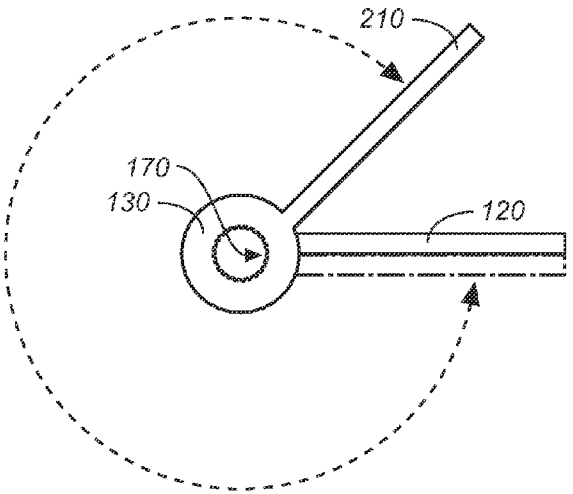
FIG. 2A is a top plan view thereof.
Figure 3:
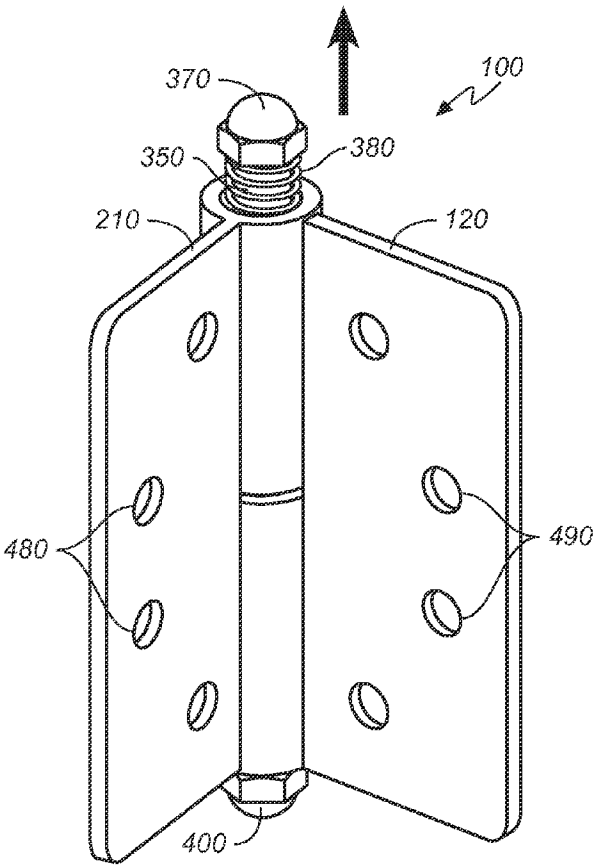
FIG. 3 shows the hinge assembly in a partly closed position and the hinge pin pushed into a locked position to prohibit all hinge leaf rotation.
Figure 4:
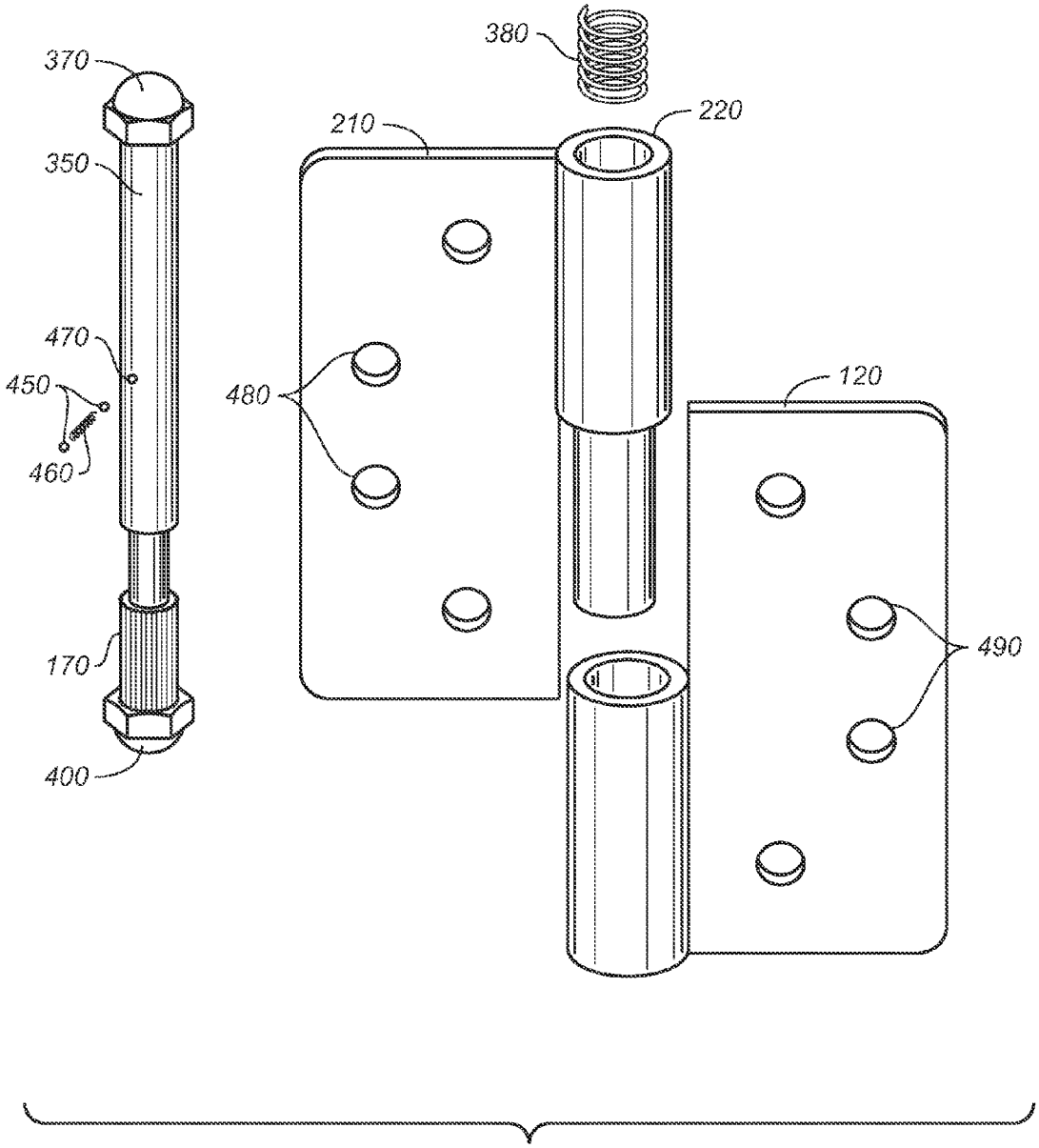
FIG. 4 is an exploded upper front perspective view of the hinge of FIGS. 1-3.
Figure 5:
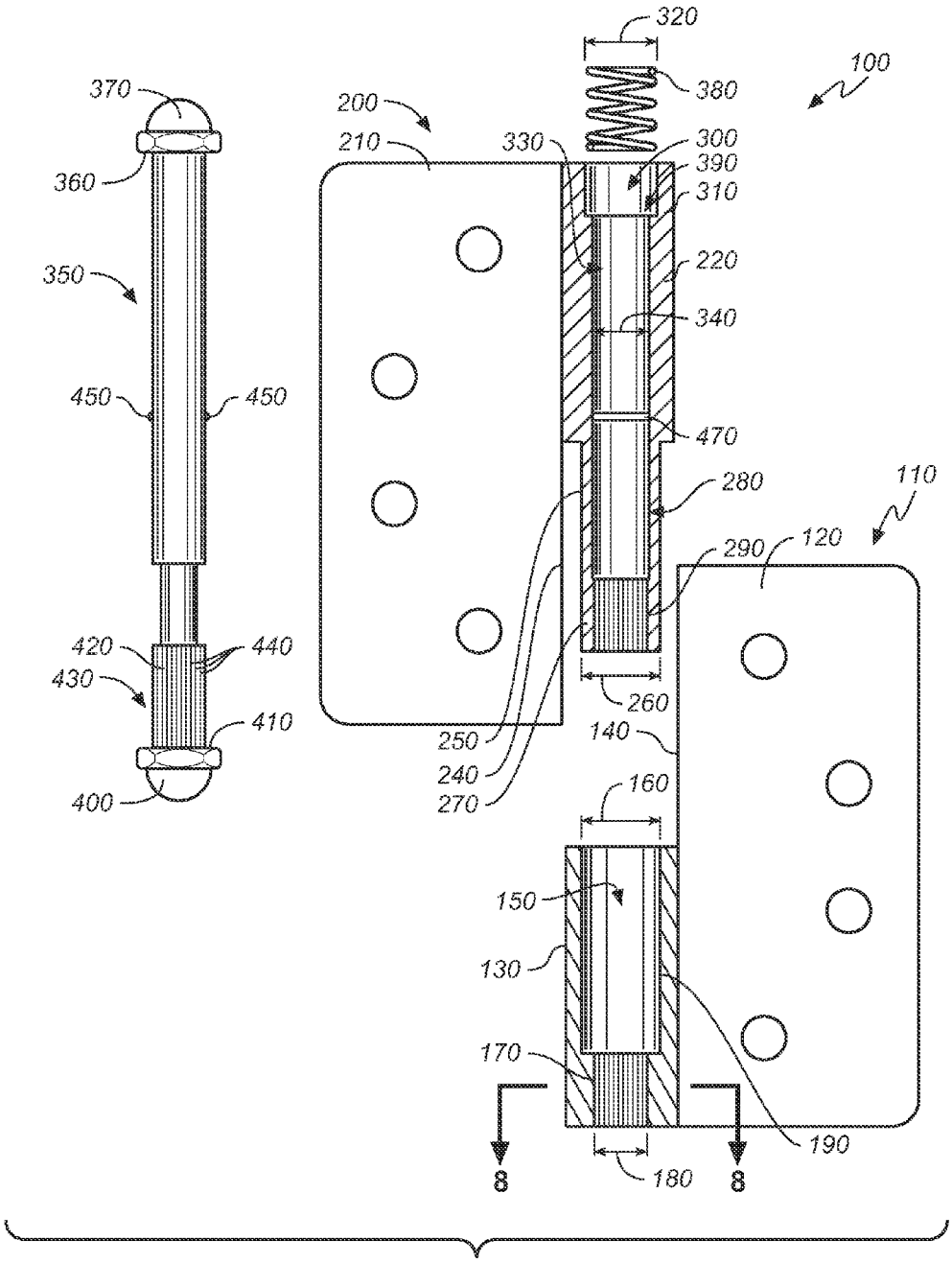
FIG. 5 is an exploded front view in elevation showing the upper and lower hinge sleeves in cross section.
Figure 6B:
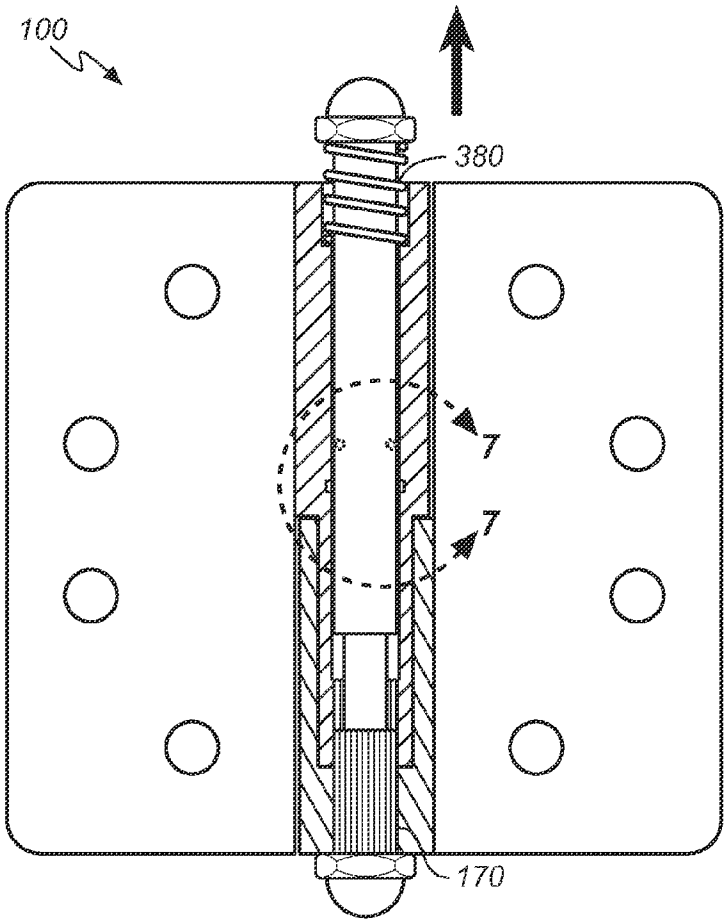
FIG. 6B is a partial cross-sectional front view in elevation showing the hinge in an unlocked position.
Figure 6A:
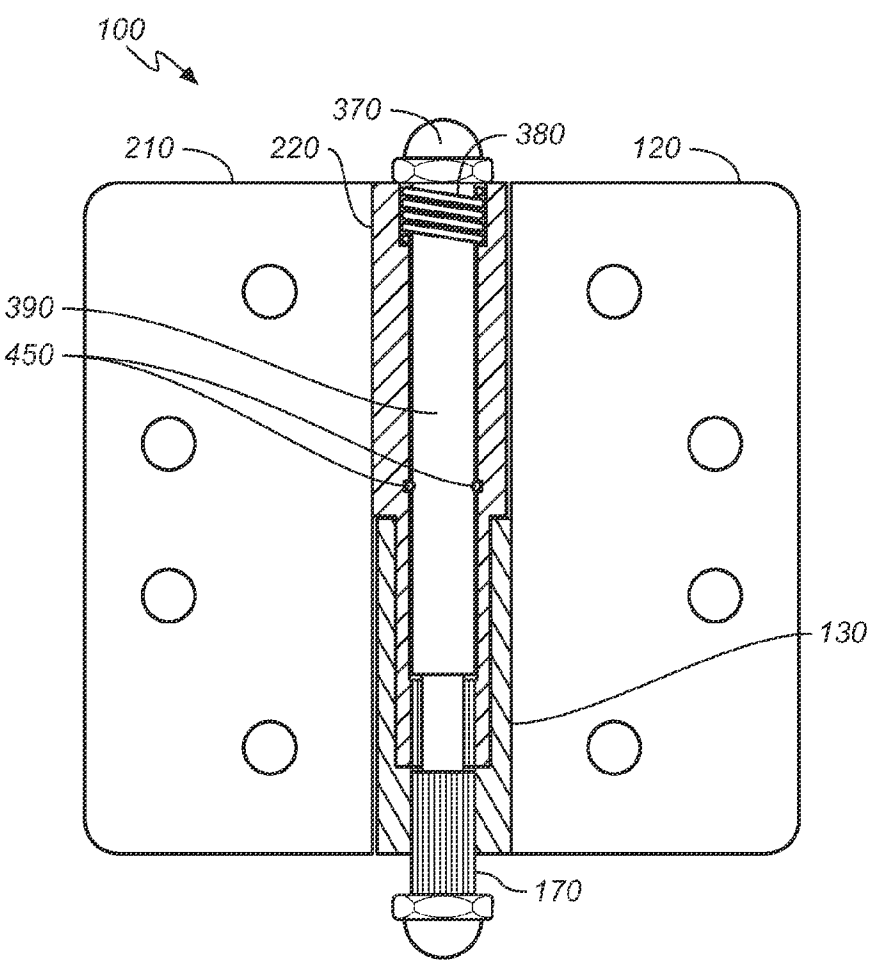
FIG. 6A is a partial cross-sectional front view in elevation taken along section lines 6A-6A of FIG. 1 showing the hinge in a locked position.
Figure 7:
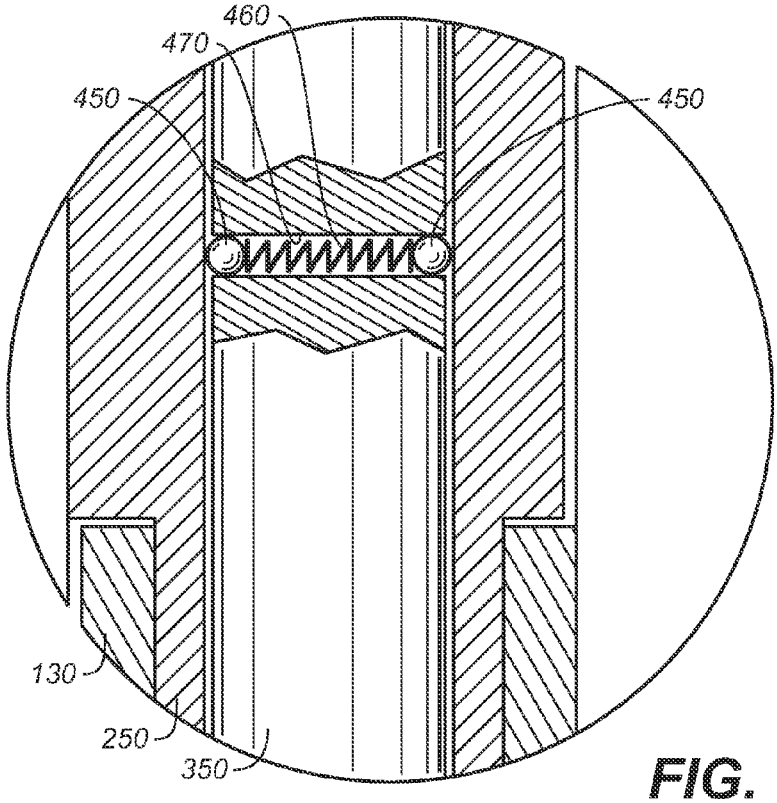
FIG. 7 is a detailed view taken along section line 7-7 of FIG. 6B, showing the spring loaded ball bearing detent used to prevent unwanted migration of the hinge pintle from either the unlocked or locked position.
Figure 8:
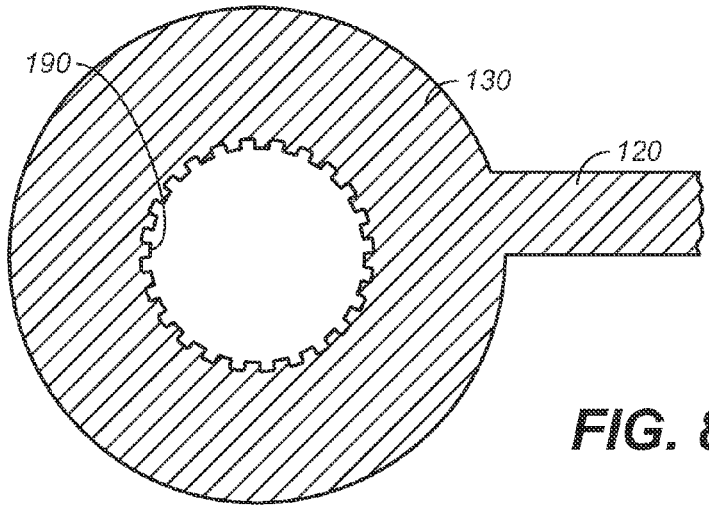
FIG. 8 is an upper cross-sectional view showing the splined interior of the lower hinge leaf taken along section line 8-8 of FIG. 5.
Figure 9A:
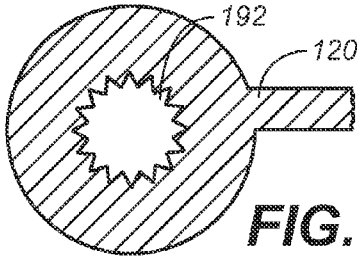
FIG. 9A shows an alternative configuration or shape for the exterior of the locking element of the hinge sleeve.
Figure 9B:
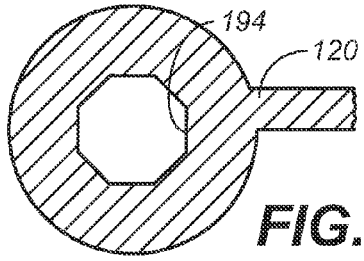
FIG. 9B shows yet another alternative configuration for the locking element of the hinge sleeve.
Figure 12:
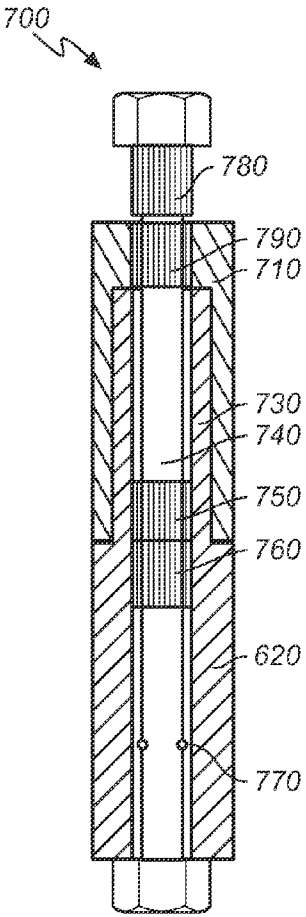
FIG. 12 is a cross-sectional side view in elevation showing the upper and lower sleeve portions and hinge pint of a fourth preferred embodiment.
Figure 11:
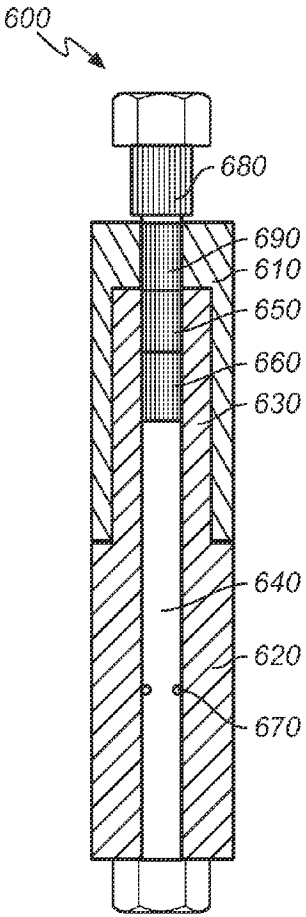
FIG. 11 is a cross-sectional side view in elevation showing the upper and lower sleeve portions and hinge pint of a third preferred embodiment.
Figure 10:
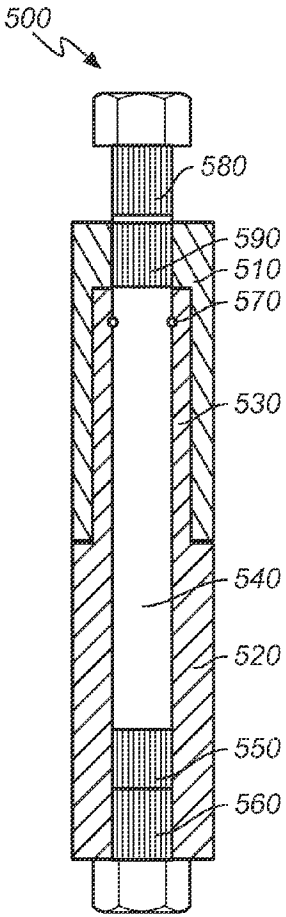
FIG. 10 is a cross-sectional side view in elevation showing the upper and lower sleeve portions and hinge pin of a second preferred embodiment of the inventive locking hinge.
Figure 13B:
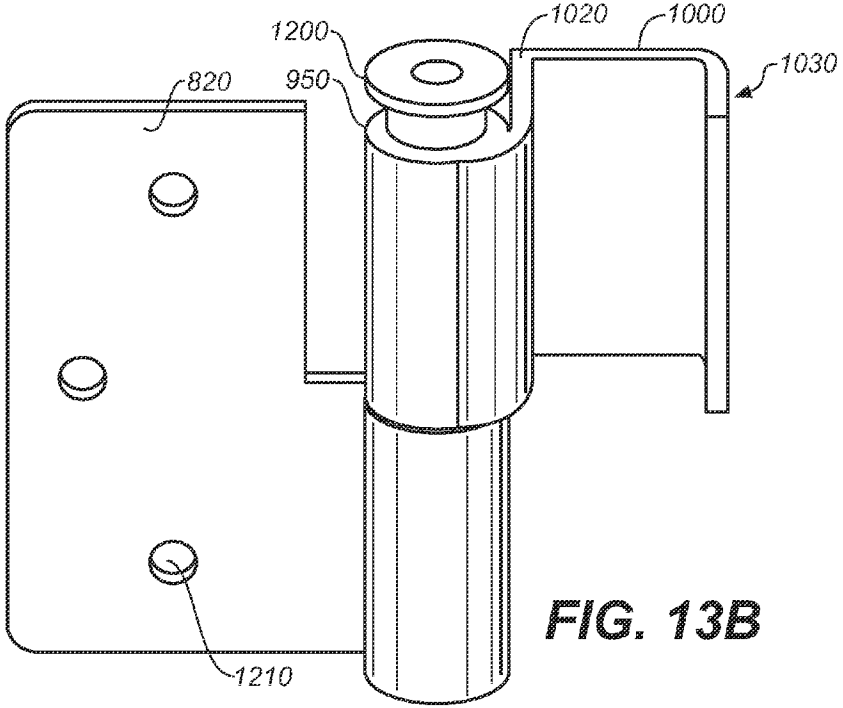
FIG. 13B is an upper front perspective showing the hinge in the locked position.
Figure 14:
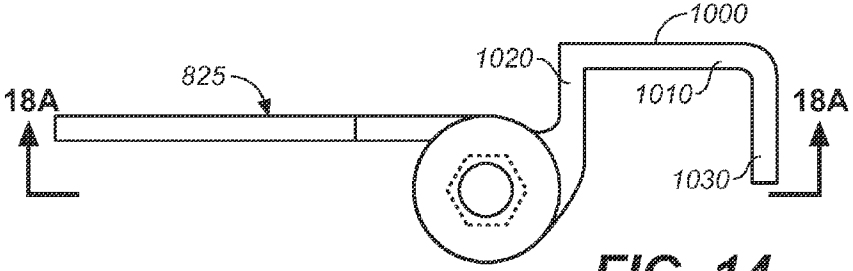
FIG. 14 is a top plan view thereof.
Figure 13A:
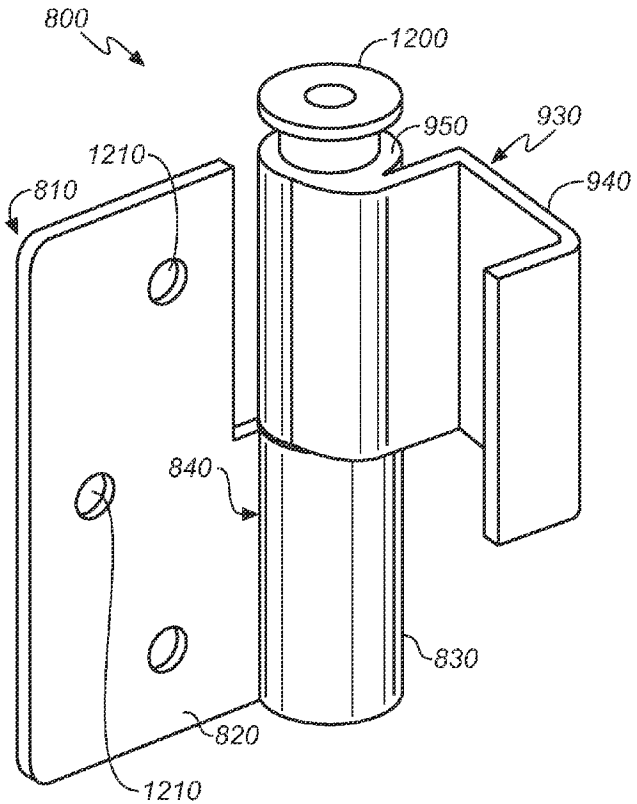
FIG. 13A is an upper front left perspective view of a fifth preferred embodiment of the present invention showing the hinge in the unlocked position.

Referring next to FIGS. 10-12, there is shown a second, a third, and a fourth preferred embodiments, respectively, 500, 600, 700, of the novel locking hinge assembly, each providing a slightly different structural relationship of the operative elements of the invention. It will be appreciated that the changes relate principally to the relocation of the cooperative splined elements and the detent mechanism either upwardly or downwardly from the positions shown in the first preferred embodiment. In all other material respects, the inventive apparatus is essentially functionally identical to the above-described first preferred embodiment.

In each of the second, third, and fourth preferred embodiments, the apparatus includes an upper sleeve portion 510, 610, 710, a lower sleeve portion 520, 620, 720, having a male element 530, 630, 730, and a hinge pin 540, 640, 740 with splines 550, 650, 750, disposed around its exterior circumference that engage splines 560, 660, 760 disposed on the interior wall of some portion of the lower sleeve when the pin is in the locked position (shown in all three views). The spring detents 570, 670, 770 prevent the pin from moving from its locked position. When pushed into the unlocked position, splines 580, 680, 780, at one end of the hinge pin engage splines 590, 690, 790 disposed in the upper sleeve portion.

FIGS. 13A through 18B show yet another embodiment of the inventive hinge assembly. In this fifth preferred embodiment 800, there is included a first hinge member 810 having a generally planar hinge leaf portion 820 and a lower cylindrical sleeve portion 830, roughly half the height of the leaf portion in dimension and extends along and is integral with the lower half of an interior edge 840 of the leaf portion. The lower sleeve 830 has an upper cylindrical passage 850 with a first diameter 860 and a lower cylindrical passage 870 axially disposed immediately under the upper cylindrical passage 850 and having a second diameter 880 greater than that of the upper cylindrical passage. The upper cylindrical passage has an interior wall 890 having a geometry or otherwise provided with a surface topography, e.g., splines, gear teeth, etc., or with a cross-sectional shape so as to function as a locking element in cooperation with the hinge pin. The lower sleeve includes an upper male element 900 extending axially upwardly from a lower female portion 910 and having an outer diameter 920 sized for a tight fit insertion into the opening of the lower cylindrical passage of the lower sleeve portion of the second hinge member (described below). The fit gives rise to a smooth pivotal connection between the two hinge members.

The hinge assembly next includes a second hinge member 930 having a latch leaf portion 940 and an upper sleeve 950, the upper sleeve including a cylindrical upper female portion 960, a medial portion 970 and a lower female portion 980. The upper and lower female portions each have an interior diameter corresponding to the outer diameter of the male element of the lower sleeve. The medial portion has an interior wall 990 corresponding in shape and size with the interior wall 890 of the lower sleeve.

The latch leaf portion 940 of the second hinge member 930, unlike that of the leaf portion of the first hinge member, is U-shaped, not planar, with bends turning in a clockwise direction as viewed from above. In the locked position (FIGS. 13B, 14) the back side 1000 of the medial plate 1010 of leaf portion 940 is generally parallel with the back side 825 of the hinge leaf portion 820 of the first hinge member. The connecting segment 1020 is integral with the upper sleeve 950 and is oriented substantially normal relative to the medial plate. The distal segment 1030 is integral with the medial plate and is preferably generally parallel with the connecting segment, thus also substantially normal relative to the medial plate.

As will be appreciated from the foregoing, when the male element 900 of the lower sleeve 830 is inserted into the lower female portion 980 of the upper sleeve 950, the holes in the upper and lower sleeves become axially aligned and form a continuous bore into which a hinge pin 1040 may be inserted. The hinge pin includes a threaded upper end 1050, a cylindrical middle portion 1060, and a contoured lower portion 1070, the latter having an outside shape that conforms to the interior wall of the medial portion 970 of the upper sleeve and the interior wall 890 of the upper male element 900. The contoured lower portion 1070 is sized for very tight clearances from the interior walls of the medial portion and male element portion. The hinge pin further includes a round head sized for tight clearances from the interior diameter 880 of the lower female portion 910 of sleeve 830. This allows the hinge pin to slide freely within the lower female portion.

A helical compression spring 1090 is disposed in the upper female portion 960 of the upper sleeve, and when the hinge pin is inserted through the aligned lower and upper sleeves, it is threadably capped with a hinge pin cap 1200.

Figure 17:
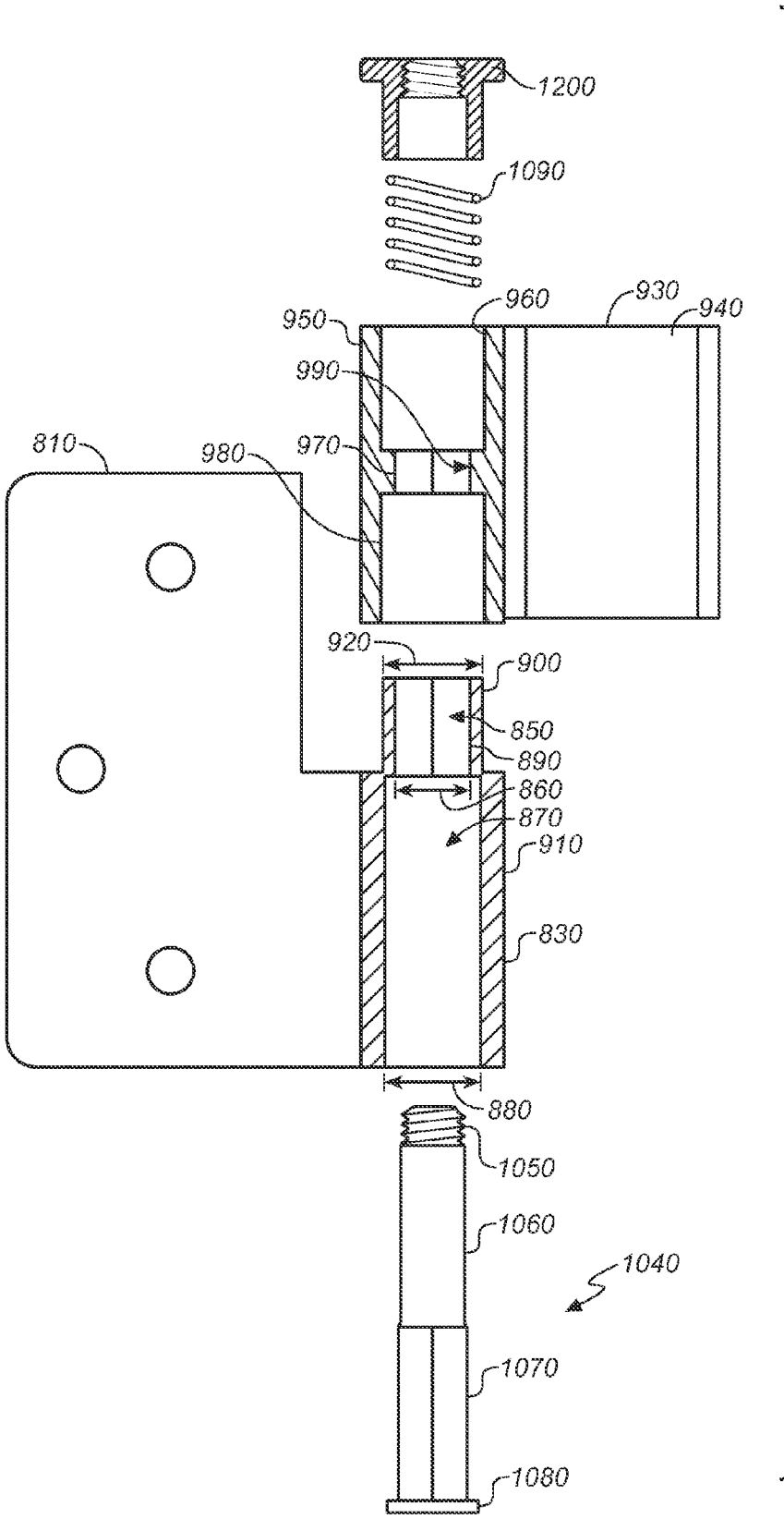
FIG. 17 is an exploded front cross-sectional view in elevation taken along section lines 18A-18A of FIG. 14.
Figure 18B:
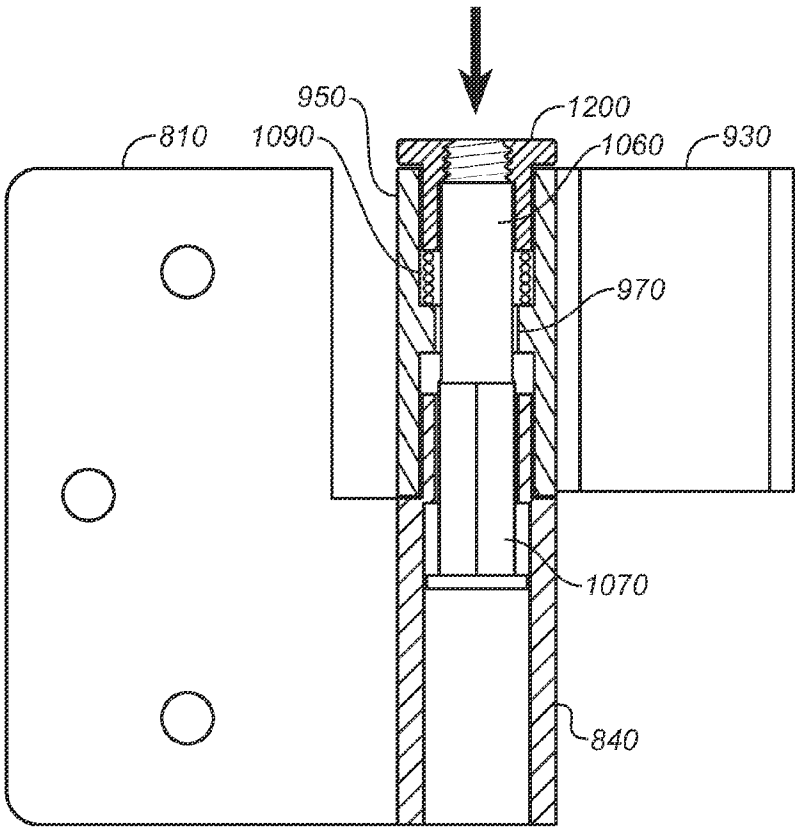
FIG. 18B is a front cross-sectional view showing the hinge in the unlocked position.
Figure 18A:
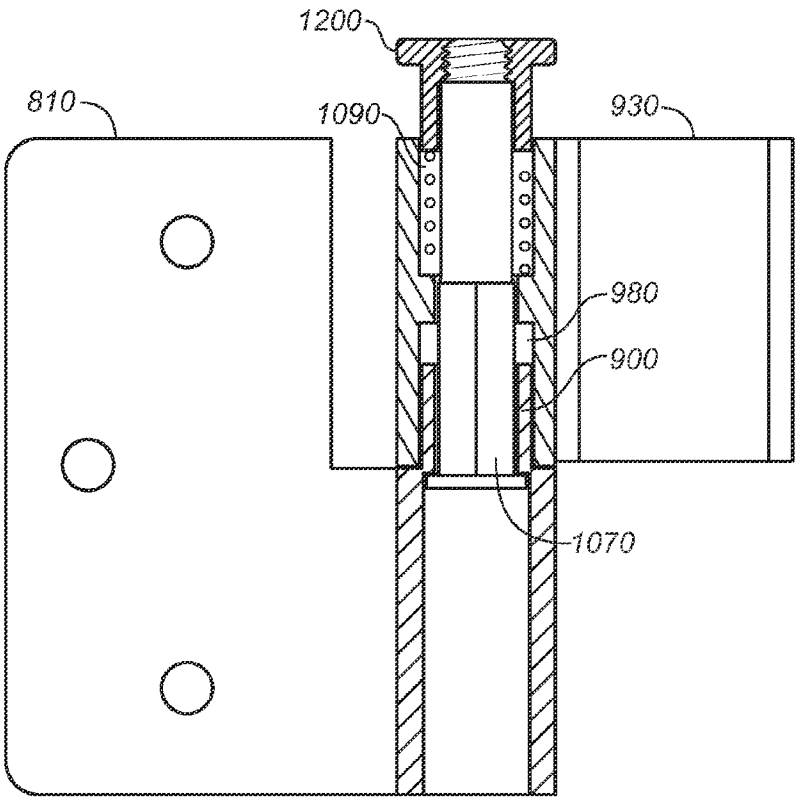
FIG. 18A is a front cross-sectional view showing the hinge in the locked position.
Figure 19B:
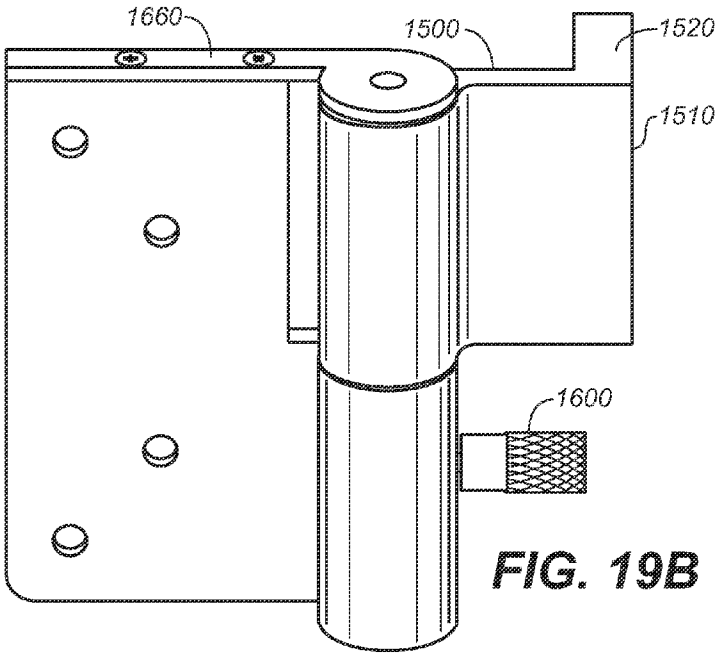
FIG. 19B is an upper front perspective showing the hinge in the locked position.
Figure 20:
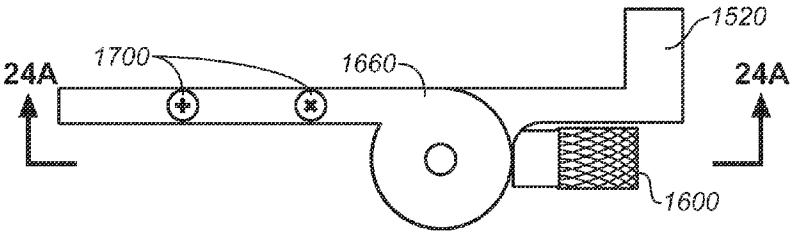
FIG. 20 is a top plan view thereof.
Figure 19A:
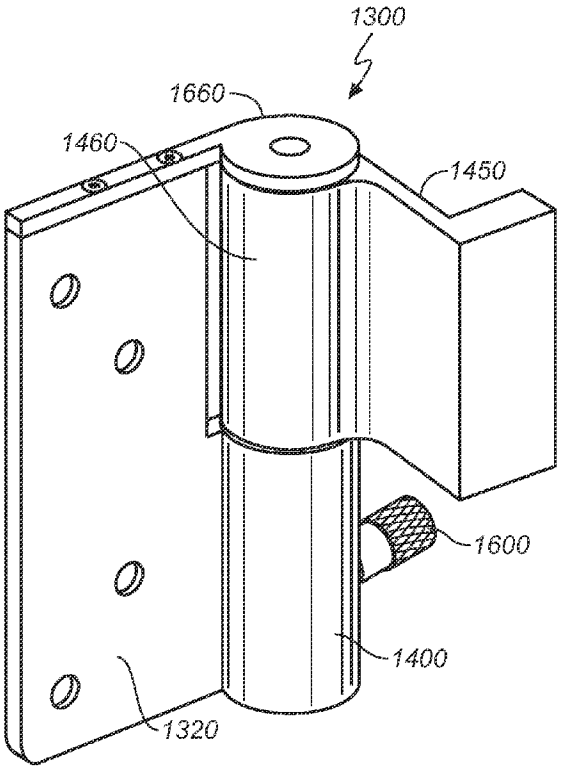
FIG. 19A is an upper front left perspective view of a sixth preferred embodiment of the present invention showing the hinge in the unlocked position.

As can be seen best by referring to FIGS. 17 and 18A-18B, the hinge pin has a length such that the most elevated position for the pin brings the base of the head into contact with the shoulder defined by the changing diameters between the lower and upper female portions of the lower sleeve. As seen in FIG. 18A, the helical compression spring urges the hinge pin upward into that most elevated position, and in so doing brings the lower portion 1070 of the hinge pin into full engagement with the interior wall 890 of the male element 900 of the lower sleeve, and the interior wall 990 of medial portion 970 of the upper sleeve.

As shown in FIG. 18B, when the hinge pin cap is pushed down, the hinge pin lower portion is pushed out from both the interior wall 890 of the male element 900 and the interior wall 990 of medial portion 970. At this time, the hinge is unlocked and the first and second hinge members can pivot freely in relation to one another. When the desired orientation of the leaf portions is achieved, the pin is simply released and allowed to elevate, thereby pulling the hinge pin back into the locked position.

Figure 15:
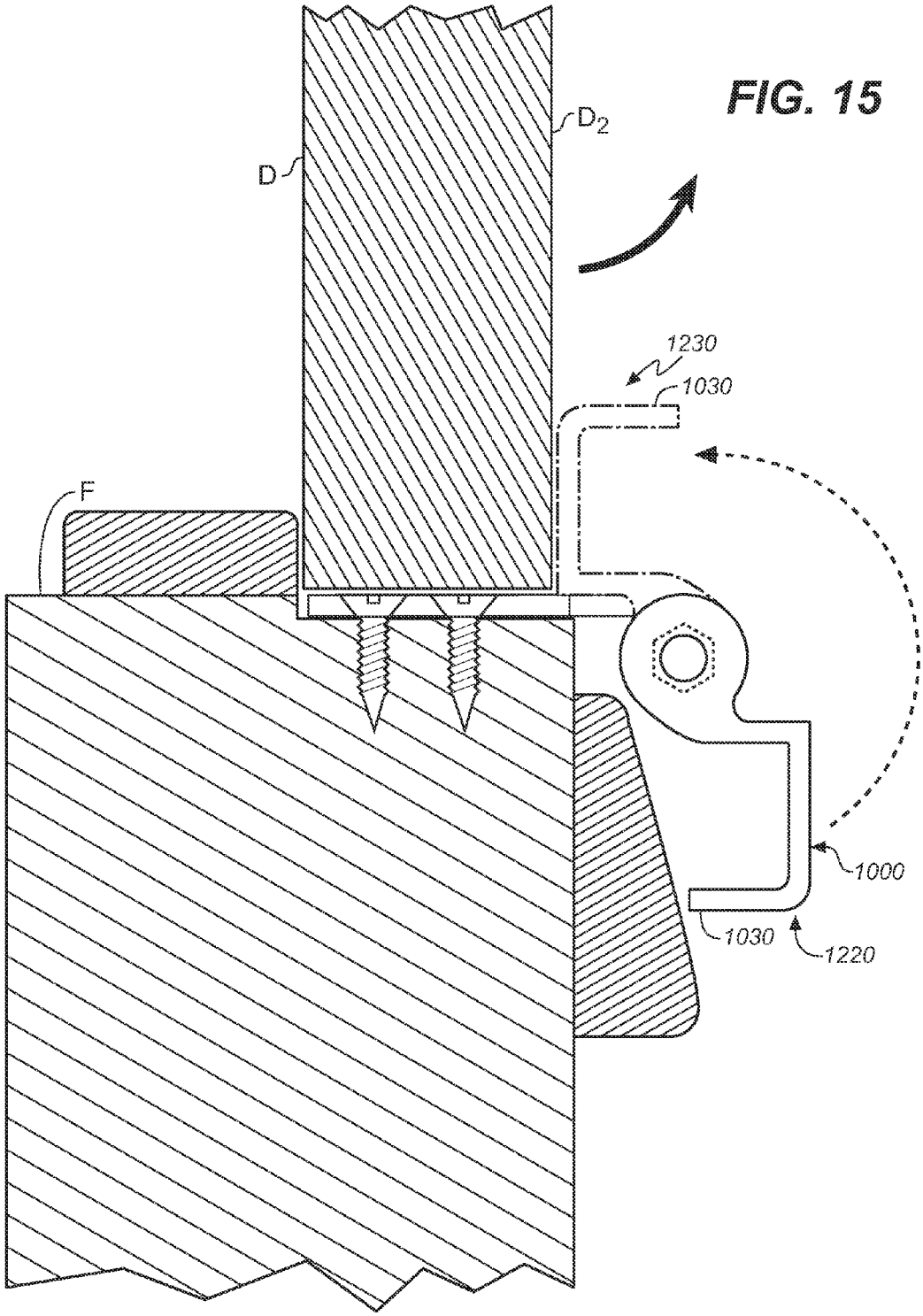
FIG. 15 is a cross-sectional top plan view showing the fifth preferred embodiment installed on a door frame and illustrating the pivot range of the latch leaf from the unlocked to the locked position.
Figure 16:
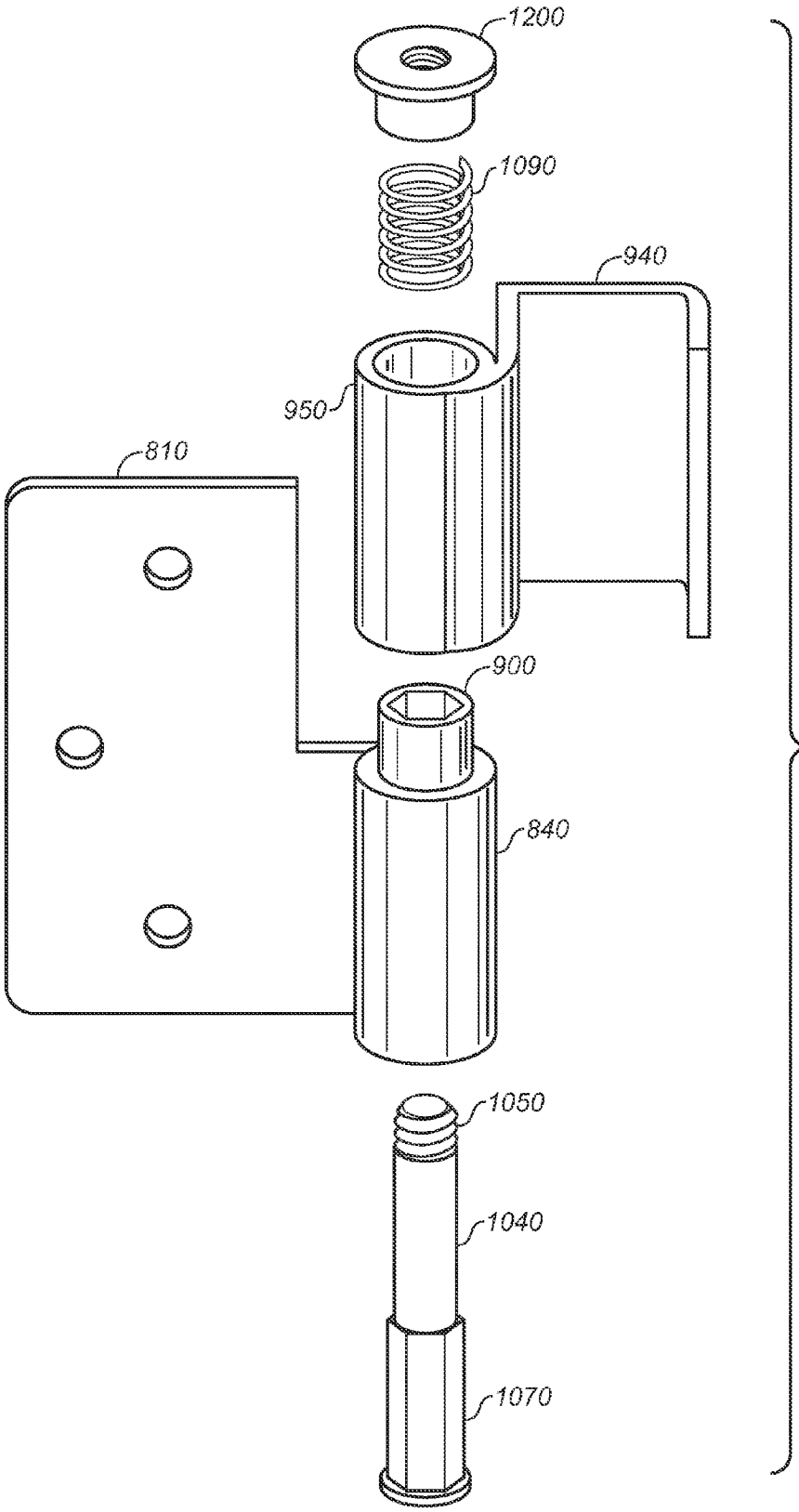
FIG. 16 is an exploded upper front perspective view of the fifth preferred embodiment.

As shown in FIG. 15, this embodiment of the present invention is recess mounted on the door frame F on the handle side of the door D. The screw holes 1210 in the hinge leaf portion allow screws to be passed and countersunk for a flush surface. The latch leaf portion is then free to pivot a full 180 degrees from a full unlocked position 1220 to a fully locked position 1230, which brings the back side 1000 of the hinge leaf portion into engagement with the interior side D2 of the door. In this position, the contoured sides of the lower portion of the hinge pin are brought into alignment with the configured interior wall of the medial portion of the upper sleeve and interior wall of the male element of the lower sleeve, as described above. The action required by the user to free the hinge latch for pivotal movement amounts to nothing more than depressing the hinge pin at its cap. To return the locking hinge to its unlocked position, the user again need only depress the hinge pin. As long as the pin is fully depressed, the latch will pivot freely. As soon as it is released, the latch will "catch" and lock wherever the configured portions are fully approximated.

In this way, the locking hinge of the present invention gives a home owner either supplemental or replacement door lock protection. A door can be either temporarily or permanently locked using the inventive hinge. If an emergency were to arise necessitating the rapid unlocking of the door to allow ingress of persons from outside or egress of persons from inside the structure, the lock can be opened quite quickly with the simple press of a button (i.e., the hinge pin cap). Conversely, if the door were unlocked and an occupant felt the need to lock it urgently, it can be swung into the locked position in one swift move.

In relation to known conventional door hinges, a significant distinguishing feature of the inventive locking hinge resides in the effect of removing the hinge pin. In the case of the prior art, the hinges essentially separate when the hinge pin is removed, much to the consternation of any handyman who has tried to remove or hang a door. By contrast, the inventive locking hinge includes a male element that slips into a female element so as to prevent such a separation. Indeed, the combined hinge members provide a fully functional hinge even without the hinge pin installed. The hinge pin provides further stability, but its essential function is not to hold the hinge members together, but to provide a rapid locking/unlocking mechanism.

In an alternative expression 1300, shown in FIGS. 19A-24B, the locking hinge of the present invention can employ a pull, rather than push, mechanism as a lock release.

FIGS. 19A through 24B show yet another embodiment of the inventive hinge assembly. This sixth preferred embodiment 1300 includes a first hinge member 1310 having a generally planar hinge leaf portion 1320 and a lower cylindrical sleeve portion 1330 integral with and extending along a lower portion of an interior edge 1340 of the hinge leaf portion. The lower sleeve 1330 has an upper passage 1350 that is square or rectangular in cross section and a lower passage 1360 disposed immediately under the upper passage. The lower passage may be cylindrical or configured with an alternative cross-sectional shape. In any event, it is sized so as to provide free clearance of the interior wall 1370 of the lower passage as the hinge leaf portion rotates about the hinge pin, as described below. The upper cylindrical passage has an interior wall 1380 having a geometry or otherwise provided with a surface topography, e.g., splines, gear teeth, etc., or with a cross-sectional shape so as to function as a locking element in cooperation with the hinge pin. The lower sleeve 1330 includes an upper male element 1390 extending axially upwardly from a lower female portion 1400 and having an outer diameter 1410 sized for a tight fit pivotal insertion into the lower cylindrical passage 1420 of the lower sleeve portion 1430 of the second hinge member 1440.

As with all previous embodiments, the sixth preferred embodiment next includes a second hinge member 1440 having a latch leaf portion 1450 and an upper sleeve 1460, the upper sleeve including an upper female portion 1470, a choked down medial portion 1480 and a lower female portion 1420. The upper female portion may be cylindrical or have an alternative cross sectional shape. However, the lower female portion is cylindrical and has an interior diameter slightly larger than the outer diameter of the male element of the lower sleeve. The medial portion 1480 has an interior wall 1490 corresponding in shape and size with the locking surface of the hinge pin (described below).

The latch leaf portion 1450 of the second hinge member 1440 is L-shaped, with a stem 1500 integral with the upper sleeve 1460 and a single outboard bend or turn 1510 directed in a counterclockwise direction as viewed from above (see, e.g., FIG. 20) to form a door-engaging leg 1520.

Figure 23:
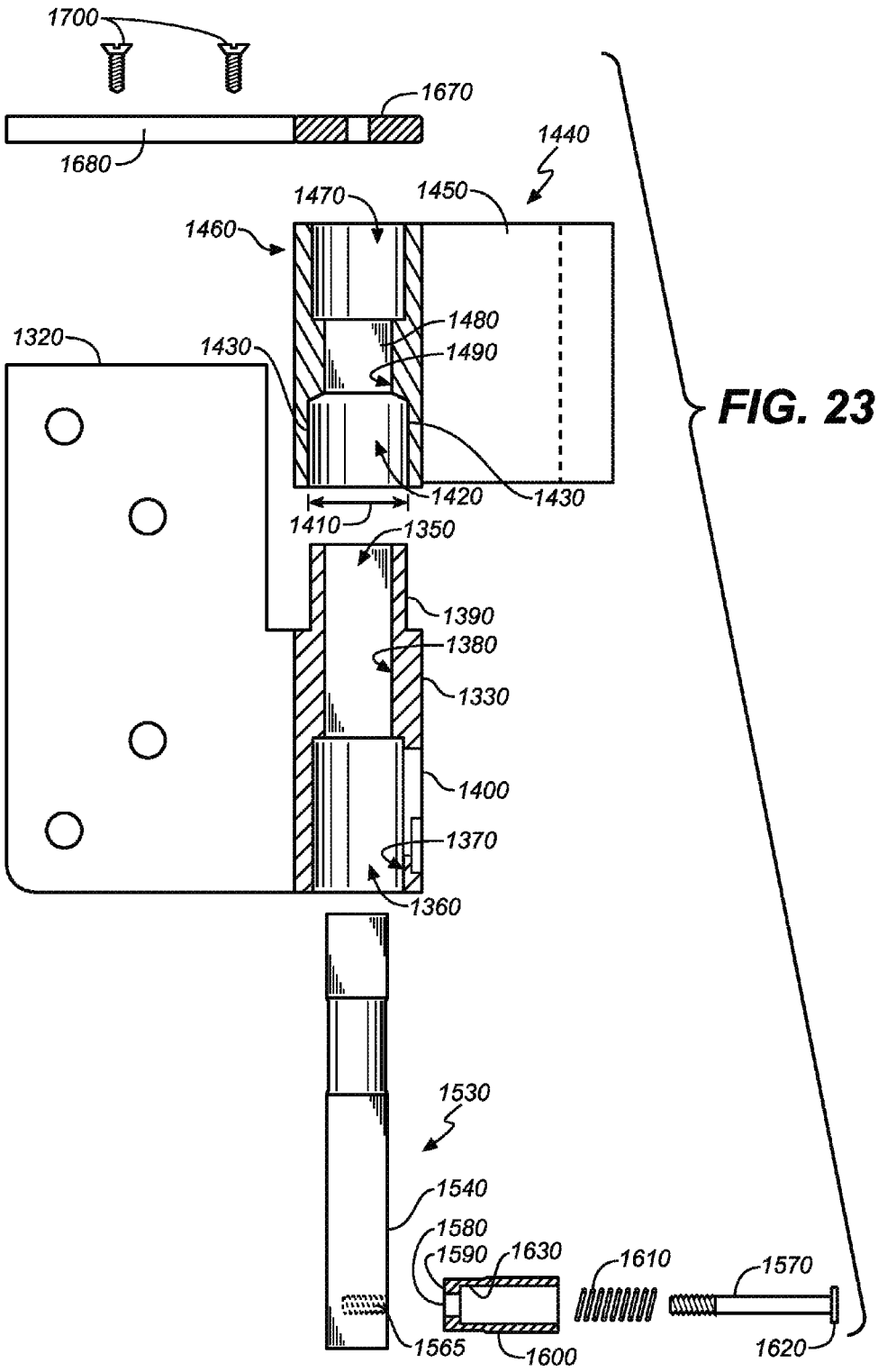
FIG. 23 is an exploded front cross-sectional view in elevation taken along section lines 24A-24A of FIG. 20.

The hinge pin employed in this embodiment departs from the design employed in the earlier embodiments. Rather than having a generally cylindrical cross-sectional shape, the pin has a generally square or rectangular cross-sectional shape, and only a portion of the hinge pin is cylindrical. Shapes other than square or rectangular may be employed for the purpose of defining the possible number of stop or lock positions available to the user when opening and closing the latch (which may be better appreciated by referring to FIGS. 21A-21B). Referring for the moment to FIG. 23, it is seen that the hinge pin 1530 comprises a head 1540 having a square or rectangular cross-sectional shape, an upper medial cylindrical neck 1550, and a lower portion 1560 preferably, though not necessarily, having a cross-sectional shape or surface topography conforming to that of head 1540. At its lower end, hinge pin 1530 includes a threaded hole 1565 that receives the thread end of a lock pin 1570 inserted through a hole 1580 in the base 1590 of a knob 1690. A spring 1610 is axially disposed around the shaft of lock pin 1570, interposed between the head 1620 of the lock pin and the inboard side 1630 of the knob.

Figure 24A:
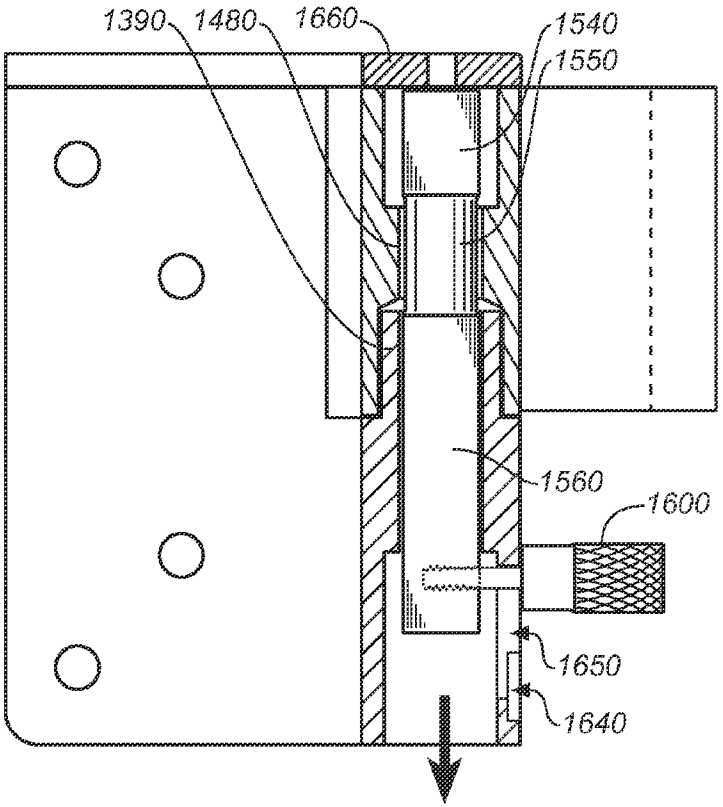

Lower sleeve 1400 includes a detent or recess 1640 in which knob 1600 is seated when in the locked position. Referring principally to FIGS. 24A-24B, it will be seen that pulling on knob 1590 compresses spring 1610 and brings base 1590 of knob 1600 out of recess 1640 and allows lock pin 1570 to slide vertically up slot 1650 disposed in the side of lower sleeve 1400. This elevates hinge pin 1530 so as to bring cylindrical medial neck 1550 into the interior space of medial portion 1480 of upper sleeve 1460, thereby unlocking the hinge so as to permit free pivotal movement of the latch leaf portion about the male element 1390 of the first hinge member and on the axis of the hinge pin.

A stopper 1660 comprising a circular cap 1670 with an elongate finger 1680 is screwed onto the upper edge 1690 of hinge leaf 1320 with screws 1700 so as to prevent the two hinge members from separating. This may be fabricated from a metal identical to that of the hinge elements or from a different, harder material according to the anticipated uses for the locking hinge.

Figure 21A:
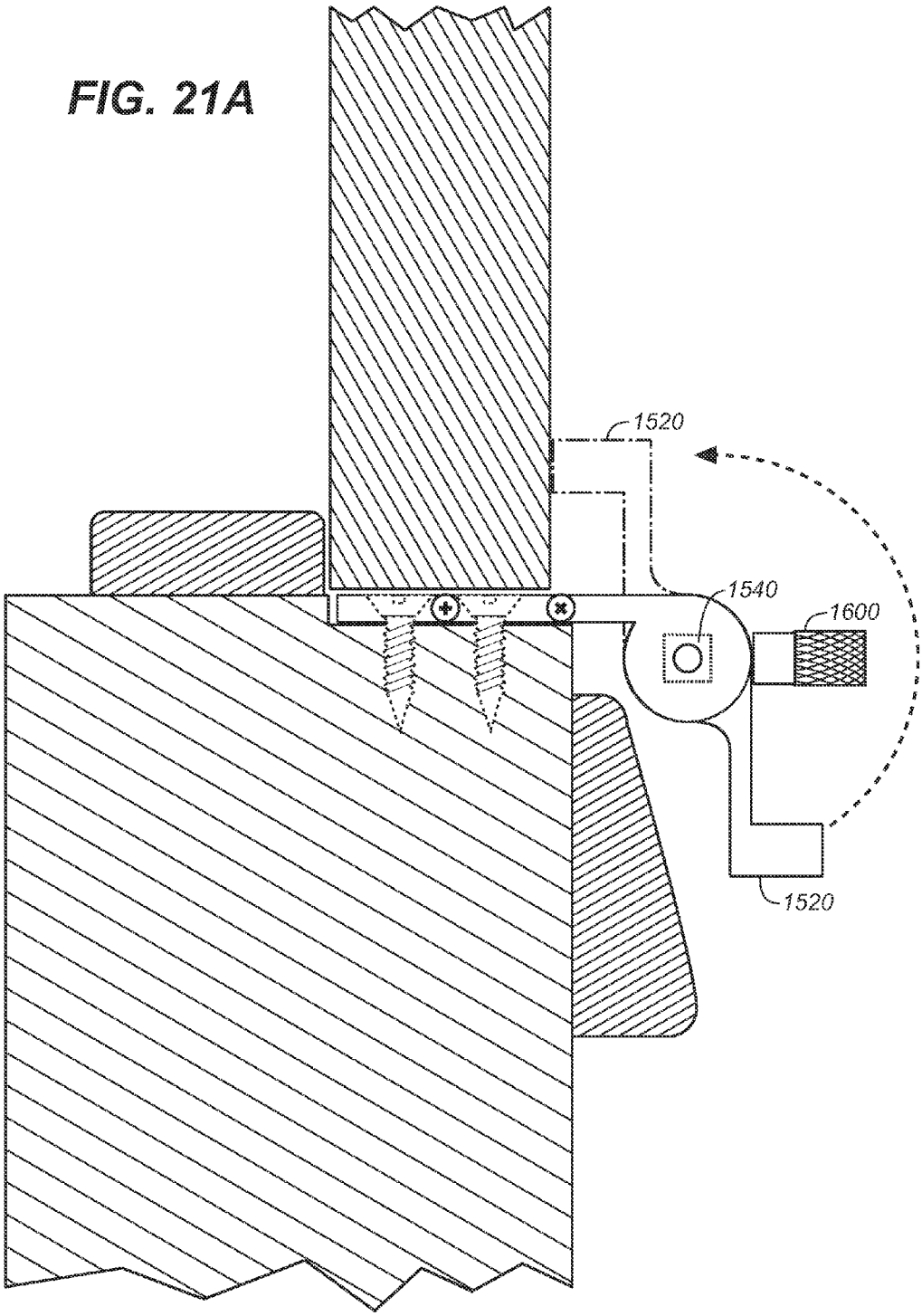
FIG. 21A is a cross-sectional top plan view showing the sixth preferred embodiment installed on a door frame and illustrating the pivot range of the latch leaf from the unlocked to the locked position.
Figure 21B:
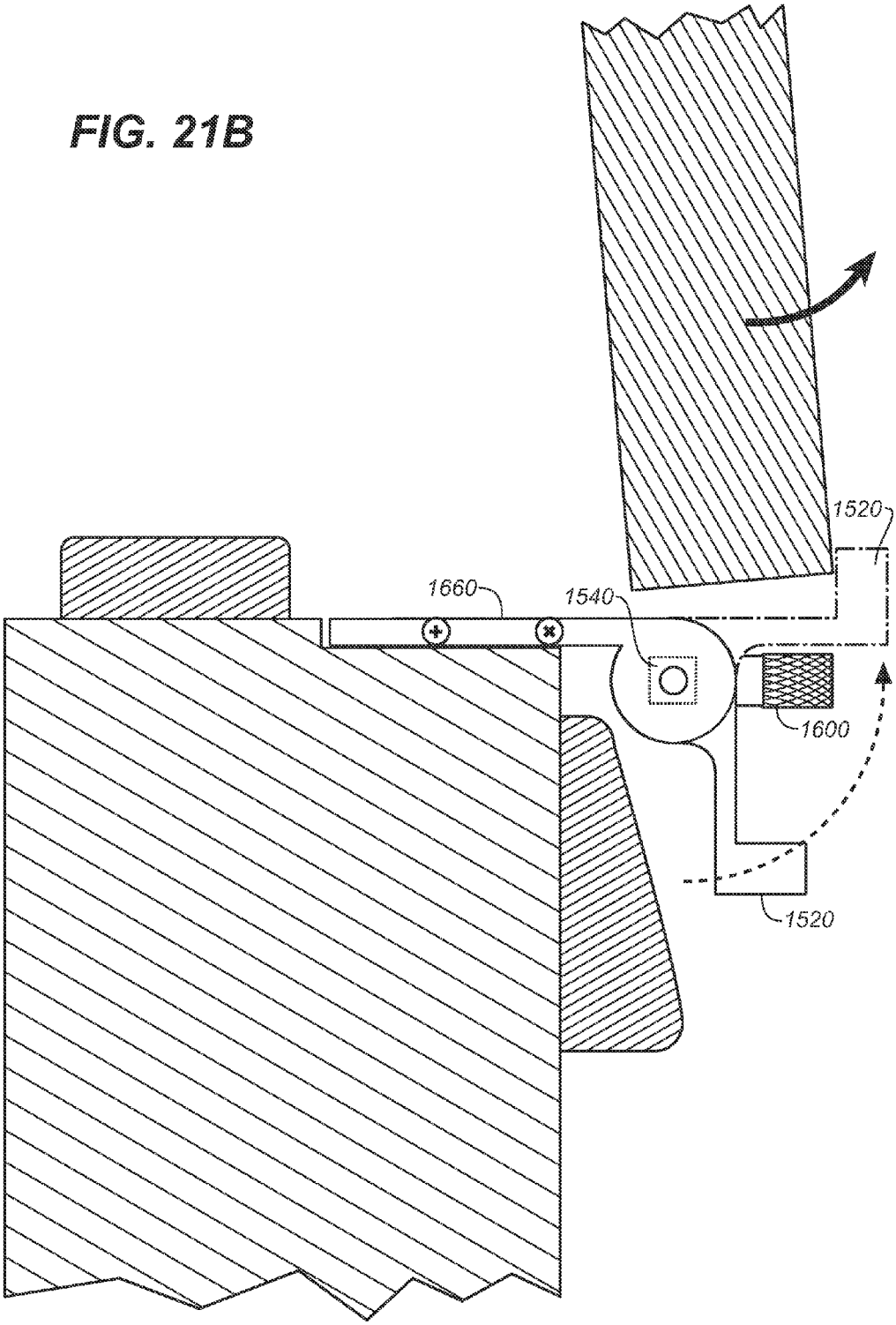
FIG. 21B is the same cross-sectional top plan view showing the latch leaf is a partially opened position.
Figure 22:
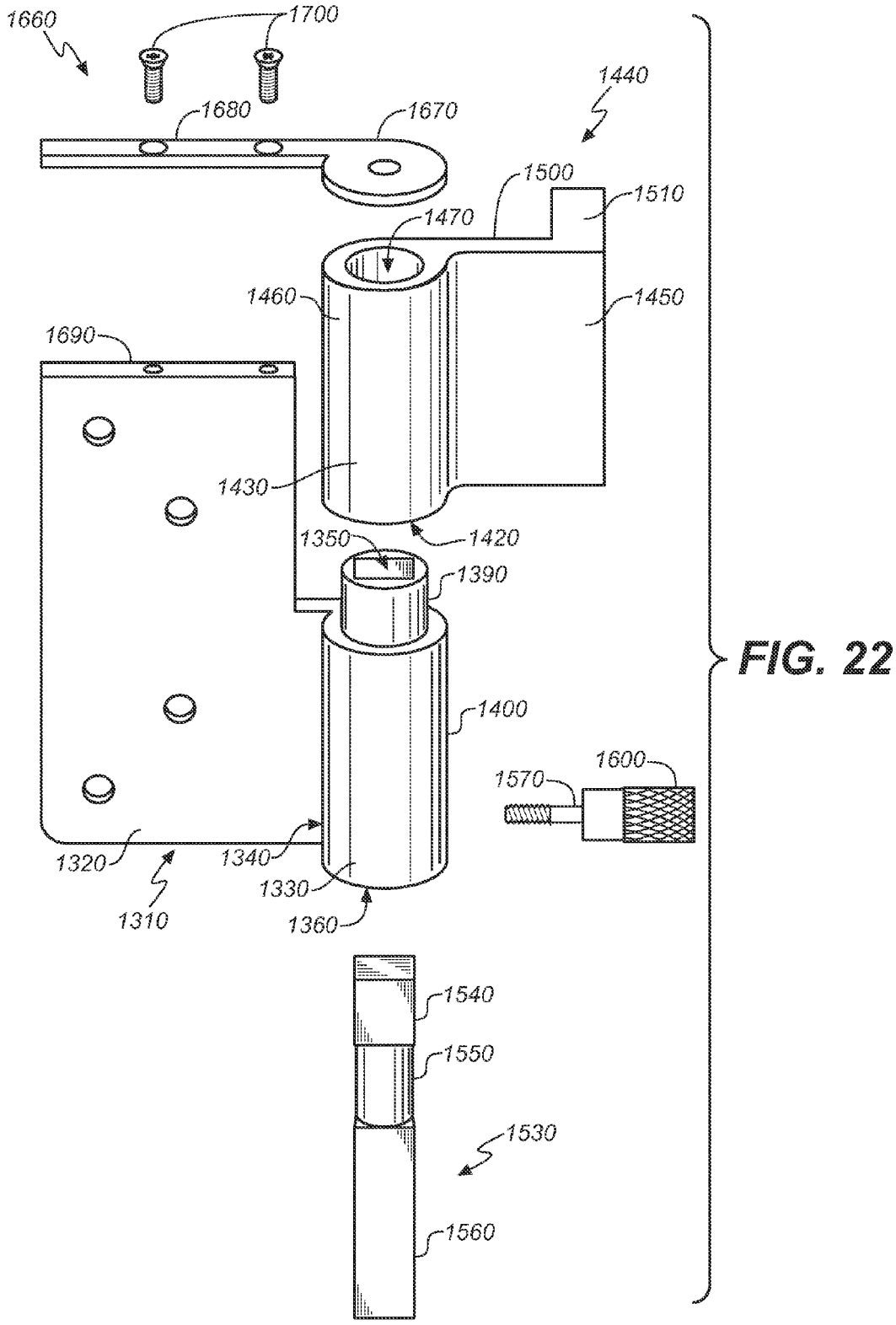
FIG. 22 is an exploded upper front perspective view of the sixth preferred embodiment.

Unique to this embodiment, and as shown in FIG. 21B, the latch leaf may be opened in stages, such that an intermediate "open" position can be achieved, thereby giving an occupant the option of having the door effectively locked (prevented from being opened to a degree needed for ingress and egress, but still allowing the occupant to look through the crack in the partially open door to determine the identity of a person standing outside. It also allows air to be circulated through the opening without having to open the door fully or to leave it unlocked.

As will be readily appreciated, the present invention has nearly unlimited applications well beyond the simple installation on doors for occupied structures. Not only may it be employed for use on lids and closures of virtually any kind, but it can be used as the hinge element for planar members that pivot in position in relation to another planar member, ready examples being workbenches, shelves, partitioning walls, and the like. Other straightforward applications include boat hatches, gates, doors, tool and tackle box lids, and so forth. The possible The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

The invention claimed is:

1. A locking hinge having a locked configuration and an unlocked configuration, comprising:

a first hinge member having a hinge leaf portion and a lower sleeve portion, said lower sleeve portion having a passage with an interior wall and an upper cylindrical male element extending axially upwardly from a lower female portion, said upper cylindrical male element having an outer diameter;

a second hinge member having a leaf portion and an upper sleeve, said upper sleeve including an upper female portion, a medial portion having an interior wall, and a lower female portion, said lower female portion being cylindrical and having an interior diameter slightly larger than said outer diameter of said upper cylindrical male element of said first hinge member, such that said upper cylindrical male element is rotatably inserted into said lower female portion;

a hinge pin having a shaped lower portion, a cylindrical medial neck, and a shaped head; and a locking apparatus for moving said hinge pin from an upper unlocked position into a lower locked position;

wherein said head of said hinge pin is shaped to conform to the shape of said medial portion of said upper sleeve, such that said head is slidably insertable with tight clearances into said medial portion of said upper sleeve; and wherein said upper female portion of said upper sleeve of said second hinge member is large enough to accommodate free rotation of said head when said hinge pin is moved into the unlocked position;

and wherein said lower portion of said hinge pin is shaped to be slidably insertable with tight clearances into said passage of said lower sleeve portion, such that when said hinge pin is in an upper unlocked position said first and second hinge members are rotated relative to one another, and when said hinge pin is in a lower locked position, said first and second hinge members are prevented from rotating relative to one another.

2. The locking hinge of claim 1, wherein said lower portion of said hinge pin has a cross-sectional shape conforming to that of said head.

3. The locking hinge of claim 1, wherein said locking apparatus comprises a spring actuated knob that engages said lower sleeve portion.

4. The locking hinge of claim 1, wherein said locking apparatus comprises a knob having a base with a hole, a lock pin disposed through the hole and having a head, a shaft and a threaded end, a threaded hole disposed in said lower portion of said hinge pin for receiving said threaded end of said lock pin, a spring axially disposed around said shaft and interposed between said head and an inboard side of said knob.

5. The locking hinge of claim 4, wherein said lower sleeve includes a recess in which the knob is seated when in the locked position.

6. The locking hinge of claim 1, wherein said passage in said lower sleeve portion is shaped such that it functions as a locking element in cooperation with said lower portion of said hinge pin, such that said first hinge member does not rotate in relation to said hinge pin.

7. The locking hinge of claim 1, wherein said second hinge member is rotated in stages, including an intermediate open position between fully open and fully closed.

8. The locking hinge of claim 1, wherein said passage of said lower sleeve portion and said lower portion of said hinge pin are each four-sided.

9. The locking hinge of claim 8, wherein said passage of said lower sleeve portion and said lower portion of said hinge pin are each either square or rectangular in cross section.

10. The locking hinge of claim 1, wherein said medial portion of said upper sleeve and said head of said hinge pin are each four-sided.

11. The locking hinge of claim 10, wherein said medial portion of said upper sleeve and said head of said hinge pin are each either square or rectangular in cross section.

* * * * *